United States Patent [19]

Wilson et al.

[11] Patent Number: 5,028,172

[45] Date of Patent: Jul. 2, 1991

[54] RETAINING WALL STRUCTURE

[75] Inventors: Hugh G. Wilson, Vernon; Wayne D. Rains, Kelowna, both of Canada

[73] Assignee: Tensa-Crete Inc., Canada

[21] Appl. No.: 152,142

[22] Filed: Feb. 4, 1988

Related U.S. Application Data

[63] Continuation-in-part of Ser. No. 837,809, Mar. 10, 1986, Pat. No. 4,728,227.

[30] Foreign Application Priority Data

Jan. 15, 1986 [CA] Canada ..... 499622

[51] Int. Cl.[5] ..... E02D 29/02

[52] U.S. Cl. ..... 405/286; 405/262

[58] Field of Search ..... 405/258, 262, 272, 284–287, 405/273, 274, 275; 403/206, 209, 347, 364

[56] References Cited

U.S. PATENT DOCUMENTS

| | | | |
|---|---|---|---|
| 1,762,343 | 6/1930 | Munster | 405/262 |
| 1,812,364 | 6/1931 | Oursler | 405/287 |
| 4,068,482 | 1/1978 | Hilfiker | 405/272 |
| 4,273,476 | 6/1981 | Kotulla et al. | 405/258 |
| 4,324,508 | 4/1982 | Hilfiker et al. | 405/284 |
| 4,329,089 | 5/1982 | Hilfiker et al. | 405/262 |
| 4,343,571 | 8/1982 | Price | 405/284 |
| 4,343,572 | 8/1982 | Hilfiker | 405/284 |
| 4,391,557 | 7/1983 | Hilfiker et al. | 405/287 |
| 4,449,857 | 5/1984 | Davis | 405/286 |
| 4,470,728 | 9/1984 | Broadbent | 405/284 |
| 4,530,622 | 7/1985 | Mercer | 405/258 |
| 4,661,023 | 4/1987 | Hilfiker | 405/262 |
| 4,824,293 | 4/1989 | Brown et al. | 405/284 |

FOREIGN PATENT DOCUMENTS

| | | | |
|---|---|---|---|
| 2422586 | 11/1975 | Fed. Rep. of Germany | 405/286 |
| 74432 | 5/1982 | Japan | 405/284 |

OTHER PUBLICATIONS

Sketch showing detail of the construction of the Tanque Verde Wall in Tuscon, Ariz.

*Primary Examiner*—Dennis L. Taylor
*Assistant Examiner*—John Ricci
*Attorney, Agent, or Firm*—Lerner, David, Littenberg, Krumholz & Mentlik

[57] ABSTRACT

There is described a new and improved soil reinforcing structure comprising a planar wall member for erection into a generally upright soil retaining position, the wall member having a front and rear surface. At least one grid member is horizontally anchored in the wall member for permanent connection thereto and to extend outwardly from the rear surface thereof. The grid member includes at least one row of apertures formed along the length thereof outside the rear surface of the wall member, and is resiliently flexible so that it may be easily and restorably folded against the rear surface of the wall member. The grid member is additionally adapted for connection by means of the row of apertures therein to a corresponding soil reinforcing grid embedded in soil retained behind the wall member to maintain the wall member in its generally upright position.

8 Claims, 5 Drawing Sheets

RETAINING WALL STRUCTURE

This application is a continuation-in-part of Ser. No. 06-837809, now filed Mar. 10, 1986 Pat. No. 4,728,227.

BACKGROUND OF THE INVENTION

The present invention relates to a soil reinforcing structure and more particularly to a gravity retaining wall system and a method of constructing the same utilizing prestressed anchoring grids to create a coherent soil block faced by an upright composite panel.

The construction of retaining wall systems using successively vertically layered grids of wire or flexible, synthetic straps or bands embedded within compacted soil and attached to a facing element for retention of the earth is well known. Examples of the soil reinforcing concept to create retaining wall structures can be found in U.S. Pat. Nos. 4,324,508 and 4,343,572 to Hilfiker, et al, and in U.S. Pat. No. 4,273,476 which issued on June 16, 1981 to Kotulla, et al.

Each of the above-identified patents describes a means of connecting wire grids or flexible bands to the facing elements of the retaining wall. The means of making this connection usually requires that the facing panels adopt a specific and dedicated structure for this purpose, or be cast in a certain way, or that the retaining wall itself actually be poured on site. In all cases, the costs of manufacture and assembly are increased.

Additionally, many of the systems based upon the reinforced soil concept require the use of numerous, relatively small facing elements assembled together to form a composite wall, and the use of so many individual pieces increases costs, particularly in terms of construction times, and leakage between abutting elements can be a problem.

SUMMARY OF THE INVENTION

It is an object of the present invention to obviate and mitigate from the disadvantages of the prior art.

It is a further object of the present invention to provide an improved means of connecting together the facing elements and the anchoring grids which permits the use of relatively large, light precast concrete panels already commercially available and which require little or no modification to the forms used to manufacture such panels. The use of larger facing panels facilitated by use of the present system provides the further advantage that each wall section is structurally independent and capable of self-support, if required.

According to the present invention, then, there is provided a soil reinforcing structure comprising upright soil retaining wall means having a front surface and a rear surface, at least one flexible anchoring grid extending rearwardly from the rear surface into compacted soil behind the wall, the grid having along its length a plurality of transverse rows of apertures, the apertures being spaced from one another by an intervening web, a second flexible grid horizontally anchored in the rear surface, having therein at least one row of apertures extending parallel to and outside the rear surface, each of the apertures being spaced from one another by an intervening web, and rod means adapted to pass through a channel formed by an interfingering of the webs and the apertures of the at least one row of apertures and one of the plurality of transverse rows of apertures to interconnect the flexible anchoring grid and the upright wall means.

According to a further aspect of the present invention, there is also provided in soil reinforcing structure including at least one generally horizontal anchoring grid embedded within the soil, and an upright soil retaining facing member connected to the anchoring grid, the improvement comprising a slip connection for connecting together the facing member and anchoring grid, the slip connection comprising at least one generally horizontal flexible connecting grid section secured within the facing member and extending rearwardly thereof, the grid section including a plurality of spaced apart apertures formed therein, the spacing corresponding to spacing between a row of corresponding apertures formed in the anchoring grid, and an elongated connecting member adapted to pass through a channel formed by bending and inserting the webs separating the apertures in one of the grid section and the anchoring grid through a row of apertures in the other of the grid section and anchoring grid to thereby connect the facing member to the anchoring grid.

According to yet another aspect of the present invention, there is also provided a facing member for a soil reinforcing structure comprising a planar wall member for erection into a generally upright soil-retaining position, the wall member having a front and rear surface, and at least one grid member horizontally anchored in the wall member for permanent connection thereto and extending outwardly from the rear surface thereof, the at least one grid member having at least one row of apertures formed along the length thereof outside the rear surface, and being resiliently flexible so that the at least one grid member is easily and restorably foldable against the rear surface of the wall member, the at least one grid member being additionally adapted for connection by means of the row of apertures therein to a respective soil reinforcing member embedded in soil retained behind the wall member to maintain the latter in the generally upright position thereof.

According to yet a further aspect of the present invention, there is also provided a method of reinforcing a soil formation, comprising the steps of erecting into a generally upright position a facing member having a front and rear surface, the rear surface having extending outwardly therefrom at least one horizontal flexible grid section with a plurality of spaced apart apertures formed therein along the length of the grid section, connecting the flexible grid section to an anchoring grid by means of an elongate rod inserted through a channel formed by overlapping the apertures in the flexible grid section with corresponding apertures formed in the anchoring grid, applying a tensile stress to the anchoring grid, and embedding the anchoring grid between layers of compacted soil behind the facing member.

BRIEF DESCRIPTION OF THE DRAWINGS

Preferred embodiments of the present invention will now be described in greater detail and will be better understood when read in conjunction with the following drawings in which.

DETAILED DESCRIPTION

Figure 1:
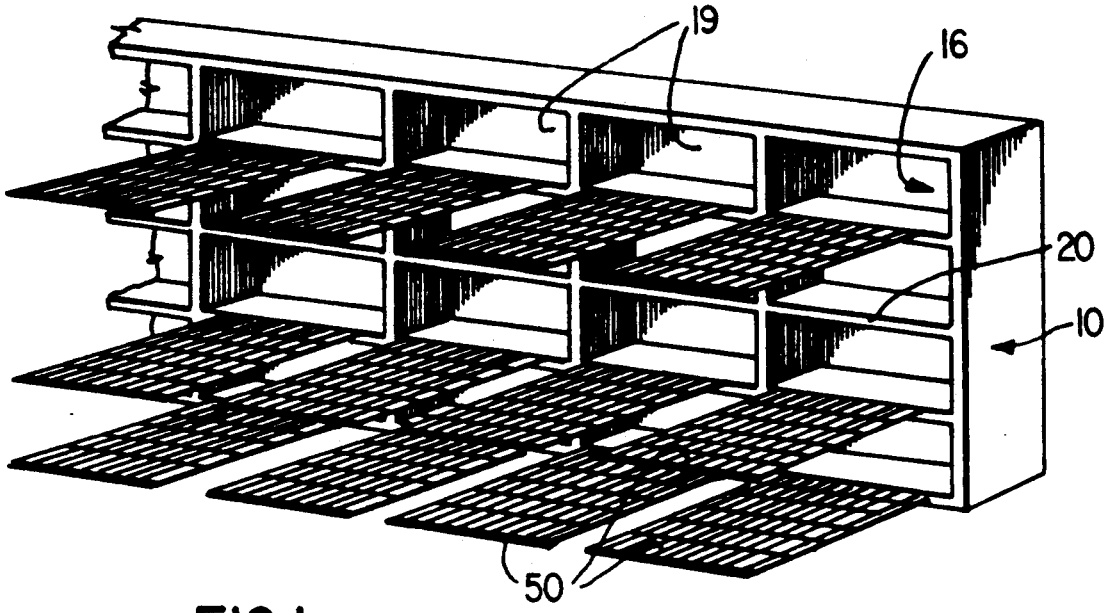
FIG. 1 is a rear perspective view of a wall panel arranged in an upright position with mesh-type anchoring grids extending rearwardly therefrom as if embedded in the soil.
Figure 2:
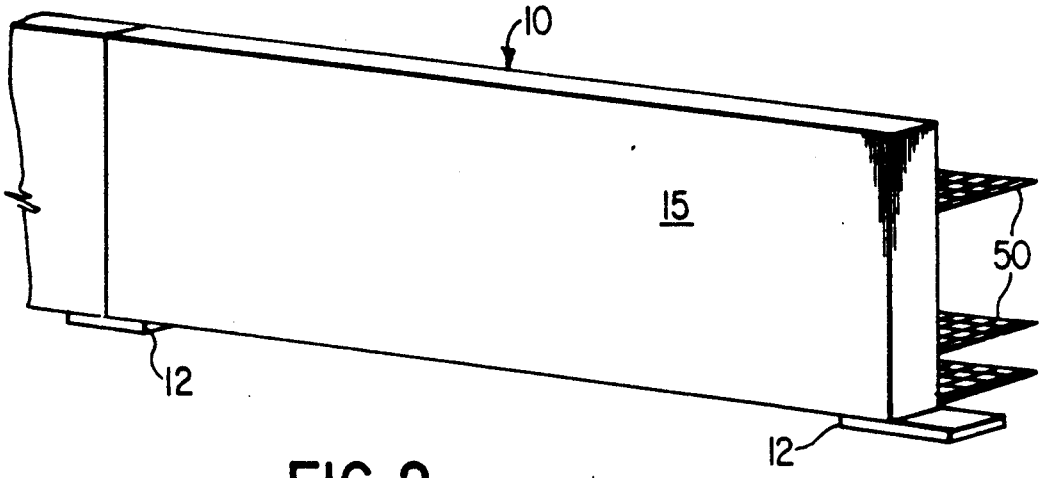
FIG. 2 is a front perspective view of an upright wall panel with the anchoring grids extending rearwardly therefrom.

With reference to FIGS. 1 and 2, the present soil reinforcing structure is shown and will be seen to include one or more substantially planar facing members such as wall panels 10 and one or more soil reinforcing or anchoring grids 50 extending horizontally from the rear surface 16 of each wall panel 10 into compacted earth or soil (not shown), behind the wall. The wall panels generally speaking require concrete foundations for support, however these are often small levelling pads 12 located at the ends of each wall section.

The wall panels themselves may be of a variety of constructions but the form shown in the appended drawings is available commercially under the trade mark WAFFLE-CRETE. These panels are primarily intended for use in the construction of buildings but have been found to be particularly well suited for use with the present soil reinforcing system.

The panels are precast reinforced concrete structures of relatively light weight which come in a variety of sizes up to eight feet by thirty feet in dimension (although larger sizes may be available). The front face 15 of each panel may be decoratively finished as desired, whereas the rear surface 16 comprises a plurality of rectangular recesses or cavities 19 separated by horizontally and vertically extending wall segments or ribs 20, which give the surface a distinctive waffle-like appearance suggesting its name.

Figure 3:
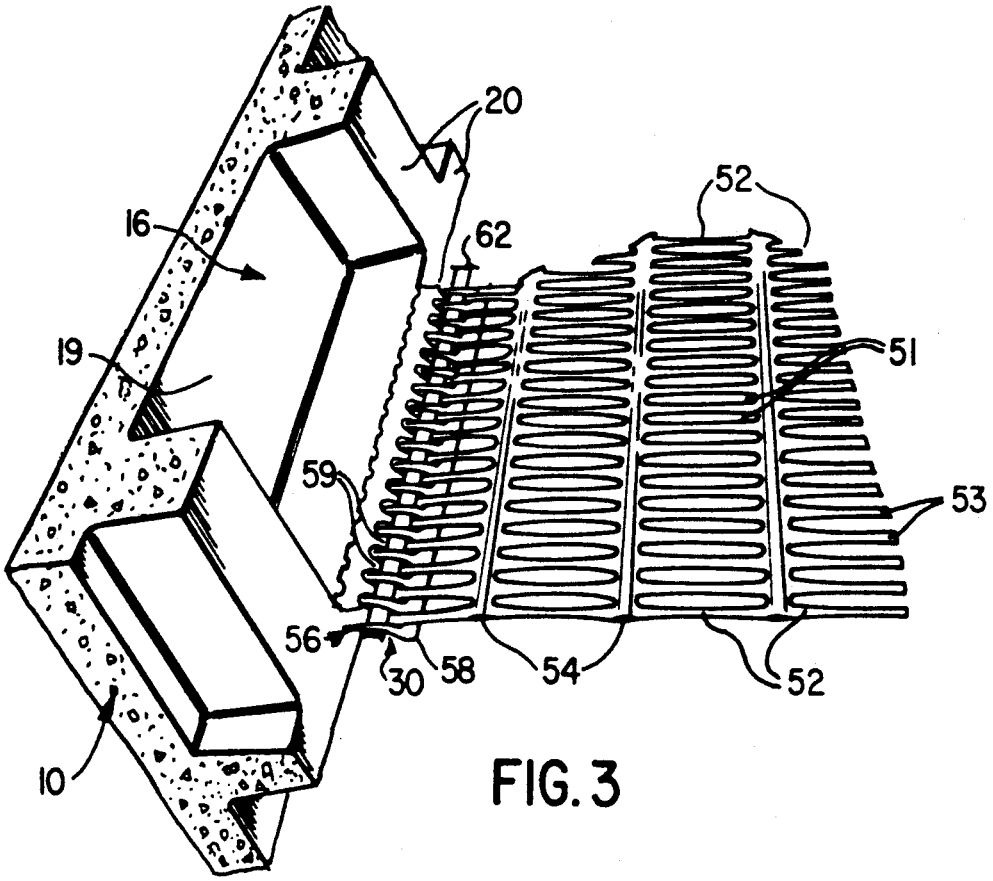
FIG. 3 is a plan view of a portion of an anchoring grid.

Reinforcing grids 50 consist preferably of strong, flexible pre-stressed synthetic geogrid, although other types of flexible materials, including wire mesh, may be used. A suitable geogrid is manufactured by the Tensar Corporation of Atlanta, Georgia and sold commercially under the trade mark TENSAR. TENSAR geogrids are a high tensile strength, chemically inert, polymer grid developed specifically for long-term (120 years) soil reinforcement applications. A section of grid is shown in FIG. 3 and it will be seen to include a plurality of spaced apart, generally elongate apertures 51 aligned into transversely extending rows 52 which proceed down the length of the geogrid. Each aperture 51 is spaced from the adjacent aperture by a web 53 of the geogrid material. Each row of apertures is separated by a rill 54 which is somewhat thicker than the grid as a whole. The grids are quite flexible and may be resiliently rolled, flexed or conformably shaped to the ground as required.

Except where specifically required for purposes of detailed illustration, the anchoring grids are shown schematically throughout the appended drawings by means of a simple cross-hatched pattern of lines.

Figure 4:
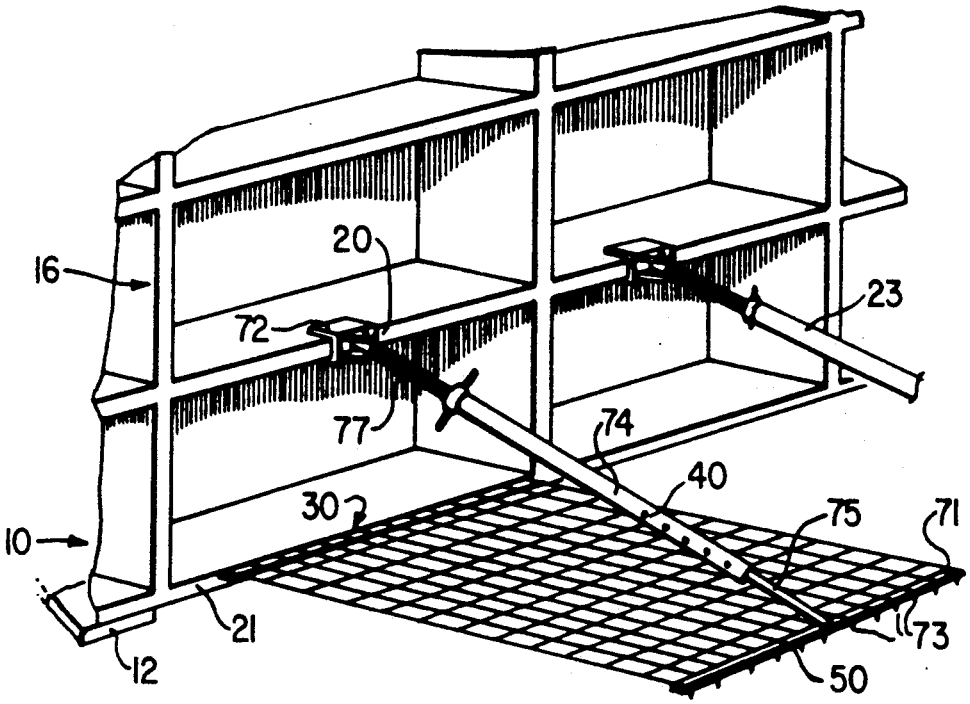
FIG. 4 is a rear perspective view illustrating the installation of an anchoring grid within the soil behind the wall panel.

With reference to FIG. 4, the installation of the wall panels and reinforcing grids is shown in greater detail. The wall panels, or one of them at a time, are erected on levelling pads 12 and are held in an upright position by means of temporary adjustable braces 23, the majority of which are typically arranged along the front faces of the panels to shore them up as fill is added behind the walls. Starting at the bottom of the rear surface 16 of each panel, a reinforcing grid 50 is attached to a lowermost rib 21 by means of a slip connection generally illustrated by the numeral 30, and the grid is then stressed using a tensioning device 40 wedged between the outer end of the grid and an upwardly adjacent rib 20. Slip connection 30 in particular forms an important part of the present system, and will be described in considerably greater detail below. Additional details of tensioner 40 are also provided hereinafter.

Once grid 50 has been tensioned, it is buried in soil, the tensioner is removed, and the soil is compacted to design requirements to the level of the next higher grid, at which point the process is repeated.

In the event of a relatively narrow wall, perhaps only one or two grids will be attached to the wall panel at each vertically spaced level. More typically however, depending upon the length of the panel, up to six or more grids, corresponding generally to the number of recesses formed along the length of the wall, will be attached at each level.

The number of layers of vertically spaced grids formed in this fashion will vary depending upon job requirements and design specifications, but the arrangement shown in FIGS. 1 and 2 including two layers adjacent the bottom of the wall with an additional layer adjacent the top is not uncommon. For a low or short wall segment, perhaps only one layer will be used.

As mentioned previously, the slip connection by means of which wall panels 10 and grids 50 are interconnected forms an important part of the present system. In this regard, it is important that the connection be quick and easy to make in the field, and that, in order to take advantage of the economies of using readily available wall panels without having to substantially modify or customize the same, the connection be readily adaptable to existing forms.

Figure 5:
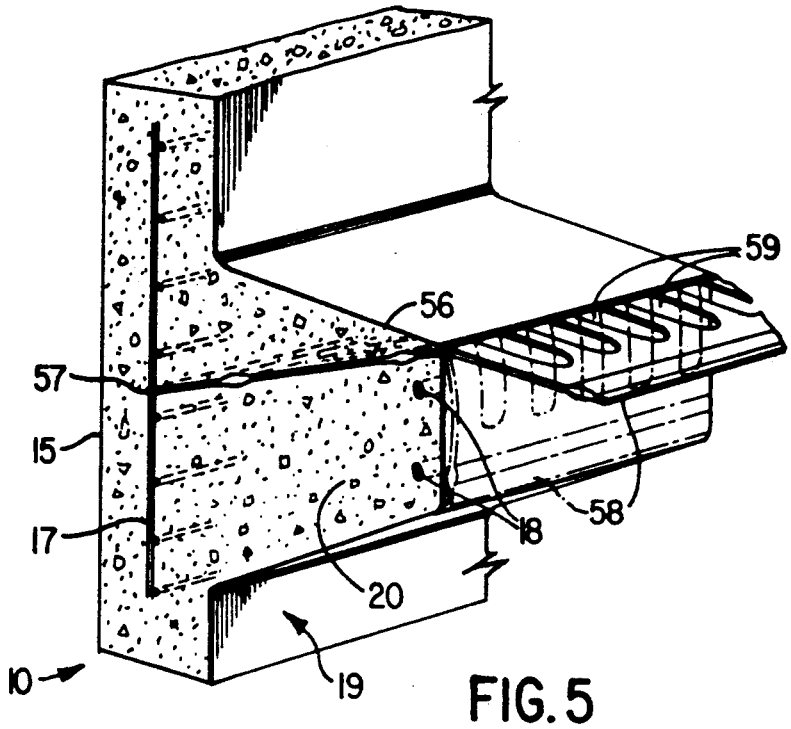
FIG. 5 is a partially cross-sectional perspective view of a portion of the wall panel illustrating the installation of part of the connecting system in the wall panel.

That part of slip connection 30 attached or anchored to the rear surface of wall panel 10 itself is most clearly seen in the partially cross-sectional view of FIG. 5, wherein like components are identified by the same reference numerals as used in the previous drawings. As aforesaid, the rear surface of wall panel 10 is waffled by a series of recesses 19 and intervening ribs 20. Each panel is precast in concrete and is reinforced by means of a wire mesh 17 within face 15 and a reinforcing bar or bars 18 adjacent the outer ends of both the horizontally and vertically extending ribs.

A resiliently flexible grid section 56, which may be of the same material as anchoring grids 50, may be tied at one end 57 to wire mesh 17 and is then cast in the wall panel so that its other end 58 extends beyond the end of rib 20. As will be described in greater detail below, at least end 58 of grid section 56 is resiliently flexible so that when the panel is actually formed, end 58 is cast against the bottom of the form and is curved or folded into the position shown in dotted lines to form part of the end surface of the rib. End 58 remains in this protected position folded against the rear surface of the panel during transport and handling, and is simply pulled or flexed outwardly into its extended position at the time of installation. This might typically involve breaking away some of the concrete chaff 99 which fills in around parts of the grid section during forming of the panel, and because of the grid section's resiliency, it will usually unfold on its own once this is done. It will be appreciated that end 58 when curled into the end surface of rib 20 will not interfere with the stacking of panels during storage or transport, as occurs with the types of connections utilized in many of the prior systems (see for example FIGS. 11 to 13 in U.S. Pat. No. 4,324,508).

For purposes of this description, the term resiliently flexible (or simply "flexible" which is sometimes used synonymously) is intended to mean the ability of the material comprising for example grid section 56 to be bent or flexed repeatedly and still regain its original shape without permanent deformation, damage or weakening.

End 58 of grid section 56 includes as shown a plurality of apertures, or partial apertures, 59 forming a row extending horizontally in a direction generally parallel to the rear surface of the wall panel. Where grid section 56 is of the same material as anchor grids 50, the number and spacing of apertures 59 will of course correspond with the number and spacing of apertures 51 in the anchor grids 50, for a given width of grid material. Otherwise, apertures 59, although they need not correspond in number if grid section 56 is not of the same material, should be spaced to align with corresponding apertures 51 forming a row of such apertures in grid 50.

Generally however the width of grid section 56 will equal that of anchor grid 50, and each will include an equal number of equally spaced apertures in each row of such apertures.

Figure 6:
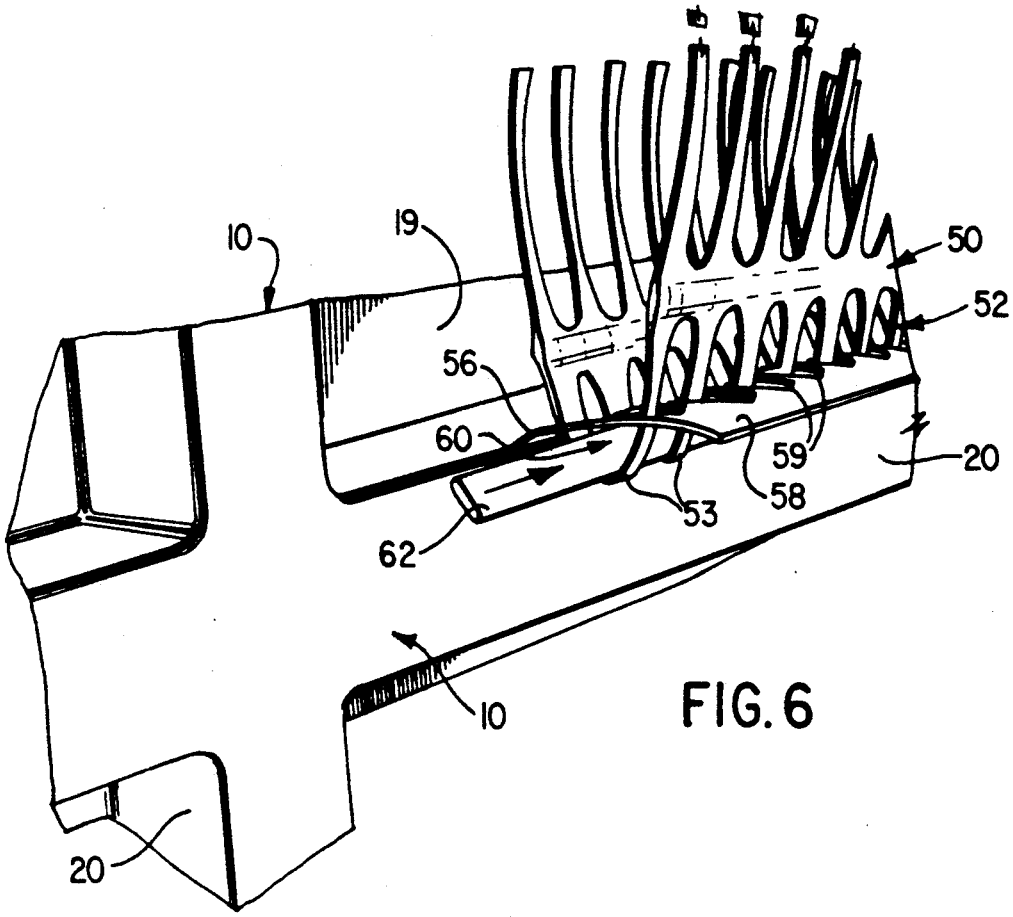
FIG. 6 is a rear perspective view of a slip connection being made.

With reference now to FIG. 6 in particular, to make the slip connection, it is merely necessary to bend the anchor grid 50 approximately along the mid-point of one of the first rows 52 of apertures so that webs 53 become generally U-shaped as shown, and to then insert or push the U-shaped webs through apertures 59 so that the webs separating apertures 59 pass through corresponding apertures 51. By interfingering and intertwining apertures 51 and 59, and their associated web portions, in this fashion, a continuous, fully encircled channel 60 is formed through the interfingered portions of the webs through which an elongate member such as a rod or flat bar 62 may be pushed to connect the two grids securely together. Anchor grid 50 is now ready to be tensioned and buried in compacted soil behind panel 10.

Rod or bar 62 may be comprised of a suitably strong, chemically inert synthetic or plastics material, or a corrosion-resistant metal.

Under load conditions, the geostatic and hydrostatic forces acting against the wall will of course result in tensile forces in the anchoring grids, and these forces will be spread evenly along the length of the slip connections, rather than being localized at a relatively few points of connection between the wall and the grid as is the case in many of the prior systems.

As illustrated, apertures 59 are only partially exposed with a portion of the length of each aperture being cast within rib 20. This has been found convenient for casting wall panels of the present sort using existing forms, but if required, more of the grid section 56 may be exposed beyond rear surface 16 to the point where apertures 59 and the webs therebetween may be bent and pushed through apertures 51 in grid 50 to make the slip connection.

Figure 7:
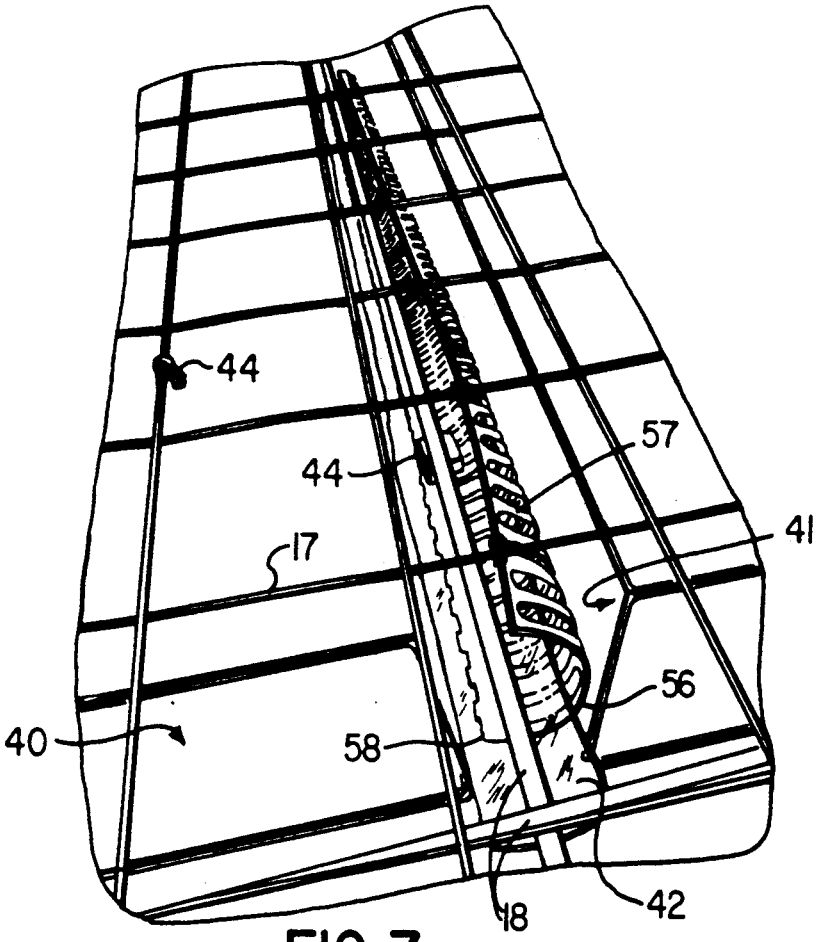
FIG. 7 is a perspective view showing the construction of a wall panel including a portion of the connecting system.

Reference will now be made to FIG. 7 showing the forming of a wall panel 10. Each panel is formed in a mold 40 including channels 41 which define ribs 20. Grid section 56 is placed in a suitable channel as shown and an impermeable membrane 42 such as a sheet of PVC plastic is draped over the lower extremity of the grid section to limit the amount of concrete flowing to the bottom of the form around this particular portion of the grid. Rebar 18 and wire mesh 17 are then positioned within the form at the desired elevation using small spacers 44 as is well known in the art. Where the inner end 57 of grid section 56 contacts or intersects wire mesh 17, the two may be tied together, if desired. Concrete is then added to the form to complete the panel.

Figure 8:
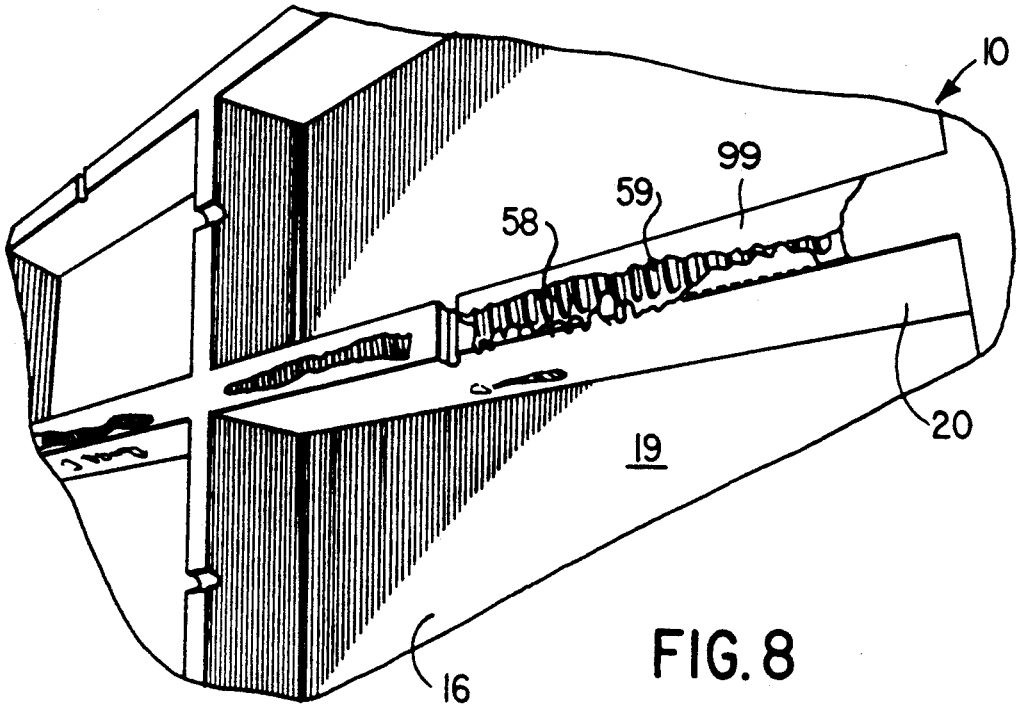
FIG. 8 is a rear perspective view illustrating the rear surface of the wall panel after removal from its form.

When the panel is withdrawn from the form, end 58 of grid section 56 cast against the rib end in the bottom of the form will be visible and will appear generally as illustrated in FIG. 8. By pulling on this folded over piece, and chipping away excess cement, end 58 will emerge into its extended position ready for connection to the corresponding anchoring grid.

As mentioned above, prior to embedding geogrids 50 in the backfill, each grid is tensioned to remove folds or kinks and to maximize frictional gradients between the soil and the grids. Tensioners 40 are used for this purpose and two different types are shown in FIGS. 9 and 10, respectively.

Figure 9:
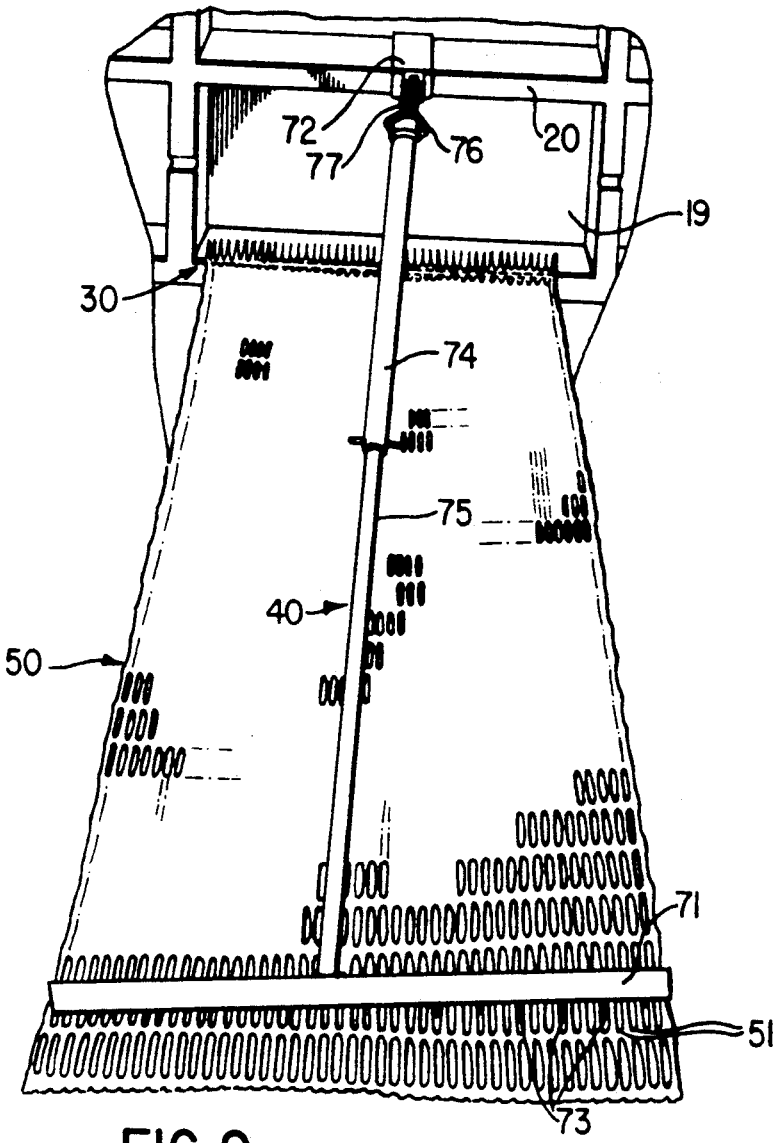
FIG. 9 is a perspective view of a tensioner for stressing the anchoring grid prior to burial in the soil.

The tensioner shown in FIG. 9 is a screw jack mechanism having a toothed rake 71 at one end and a generally U-shaped saddle bracket 72 at the other end for engaging a next higher rib 20. Rake 71 includes a plurality of teeth or tynes 73 which engage apertures 51 in one of the trailing rows of apertures in the geogrid. Gross adjustments to the length of the tensioner are made by means of a telescopic connection between a sleeve 74 and tube 75. Final tensioning adjustments are made by means of a bushed crank 76 and a cooperating threaded rod 77 to which saddle bracket 72 is attached.

Figure 10:
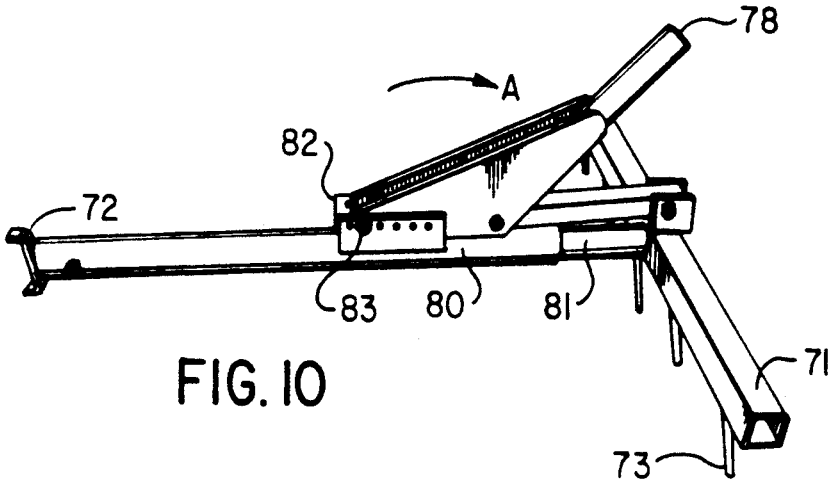
FIG. 10 is a perspective view of another type of tensioner.

An alternative form of tensioner is shown in FIG. 10 wherein the screw jack is replaced by a cam lock lever 78. By rotating lever 78 in the direction of arrow A, the length of the tensioner is increased as sleeve 80 is moved past tube 81, and vice versa. The fulcrum 83 for the levered system as shown is also adjustable depending upon the point of attachment thereof to bracket 82.

It will be appreciated from the above that a new and improved system has been described for interconnecting facing elements with mesh-type anchoring grids offering improved performance in terms of simplicity of construction, decreased assembly time, and the economic advantages of using pre-existing wall panels. It will be further appreciated in this regard that whereas the use of WAFFLE-CRETE panels has been described, such use is exemplary only and the present connecting system can be utilized in or with wall panels of practically any construction.

The principles, preferred embodiments and modes of operation and construction of the present invention have been described in the foregoing disclosure. The invention which is intended to be protected herein however is not to be construed as limited to the particular embodiments disclosed, since these embodiments are to be regarded as illustrative rather than restrictive. Variations and changes may be made by others without departing from the spirit or scope of the invention. Accordingly, it is expressly intended that all such variations and changes which fall within the spirit and scope of the invention be included within the scope of the following claims.

We claim:

1. A facing member for a soil reinforcing structure comprising, a planar wall member for erection into a generally upright soil-retaining position, said wall member having a front surface and a rear surface, said rear surface including at least one vertical row of rectangular cavities and a plurality of intervening rib segments separating said rectangular cavities from one another, and at least one resiliently flexible grid member having a first edge horizontally embedded within one of said rib segments for permanent connection to said wall member and an opposite edge extending freely in an outward direction from said rear surface of said wall member, said at least one flexible grid member capable of being folded flatly against said rear surface of said wall member and restored to said outwardly extending direction, said at least one flexible grid member having at least one row of apertures formed along the length thereof outside said rear surface and being adapted for connection by mans of said row of apertures to a soil reinforcing member embedded in soil retained behind said wall member to maintain said wall member in said generally upright position.

2. The facing member as claimed in claim 1 including a plurality of said flexible grid members disposed in vertically spaced relationship on said rear surface of said wall member.

3. The facing member as claimed in claim 1 wherein said planar wall member is formed of concrete with crosscrossing reinforcing members included therein, said first edge of said at least one flexible grid member being connected to one of said reinforcing members.

4. A facing member for a soil reinforcing structure comprising, a planar wall member for erection into a generally upright soil-retaining position, said wall member having a front surface and a rear surface, and at least one resiliently flexible grid member embedded within said wall member, said at least one flexible grid member being at least partially covered by a chaff to hold said at least one flexible grid member securely against said rear surface of said wall member and having a first edge embedded within said wall member for permanent connection thereto and an opposite edge freely extendable outwardly from said rear surface upon removal of said chaff, said at least one flexible grid member being restorably foldable flatly against said rear surface of said wall member and having at least one row of apertures formed along the length thereof outside said rear surface and being adapted for connection by means of said row of apertures to a soil reinforcing member embedded in soil retained behind said wall member to maintain said wall member in said generally upright position.

5. The facing member as claimed in claim 4 including a plurality of said resiliently flexible grid members disposed in vertically spaced relationship on said rear surface of said wall member.

6. The facing member as claimed in claim 4 wherein said rear surface includes at least one vertical row of rectangular cavities, and a plurality of intervening rib segments separating said rectangular cavities from one another, said at least one flexible grid member being embedded within one of said rib segments.

7. The facing member as claimed in claim 6 including a plurality of said resiliently flexible grid members disposed in vertically spaced relationship on said rear surface of said wall member.

8. The facing member as claimed in claim 6 wherein said planar wall member is formed of concrete with crisscrossing reinforcing members included therein, said first edge of said at least one flexible grid member being connected to one of said reinforcing members.

* * * * *